US006761381B2

(12) United States Patent
Prada et al.

(10) Patent No.: US 6,761,381 B2
(45) Date of Patent: Jul. 13, 2004

(54) METHODS AND APPARATUS FOR SECURING A DISHWASHER DOOR

(75) Inventors: Luis Esteban Prada, Louisville, KY (US); Gregory Owen Miller, Louisville, KY (US); Christopher Raymond Geisen, Louisville, KY (US); Wenfeng Lu, Mason, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/682,255

(22) Filed: Aug. 9, 2001

(65) Prior Publication Data

US 2003/0030284 A1 Feb. 13, 2003

(51) Int. Cl.[7] ..... E05C 19/10

(52) U.S. Cl. ..... 292/121; 292/95; 292/109; 292/122; 292/DIG. 53; 292/DIG. 69

(58) Field of Search ..... 292/121, 95, 122, 292/DIG. 53, 109, DIG. 69

(56) References Cited

U.S. PATENT DOCUMENTS

| | | | | | |
|---|---|---|---|---|---|
| 86,686 | A | * | 2/1869 | Peterson | 292/121 |
| 97,985 | A | * | 12/1869 | Still | 292/91 |
| 512,517 | A | * | 1/1894 | Ottenheimer | 292/80 |
| 527,043 | A | * | 10/1894 | Beck | 292/259 R |
| 960,777 | A | * | 6/1910 | Barnwell | 292/121 |
| 1,075,367 | A | * | 10/1913 | Merritt | 292/99 |
| 2,028,954 | A | * | 1/1936 | Roedding | 292/126 |
| 2,741,505 | A | * | 4/1956 | Courney | 292/341.17 |
| 3,005,065 | A | * | 10/1961 | Jellies | 200/61.62 |
| 3,229,061 | A | * | 1/1966 | Harroff | 200/61.62 |
| 3,415,961 | A | * | 12/1968 | Barnard | 200/61.64 |
| 3,684,343 | A | * | 8/1972 | Hancock | 312/223 |
| 3,713,681 | A | * | 1/1973 | Worley | 292/78 |
| 3,841,675 | A | * | 10/1974 | Mercer | 292/241 |
| 3,841,677 | A | * | 10/1974 | Guth | 292/335 |
| 3,853,366 | A | * | 12/1974 | Kesling et al. | 312/223 |
| 3,876,469 | A | * | 4/1975 | Schimke | 134/95 |
| 3,912,891 | A | * | 10/1975 | Mercer et al. | 200/61.67 |
| 3,924,085 | A | * | 12/1975 | Stone | 200/61.62 |
| 3,985,023 | A | * | 10/1976 | Guth | 70/267 |
| 3,997,201 | A | | 12/1976 | DeSchaaf et al. | |
| 4,013,312 | A | * | 3/1977 | DeWeese | 292/113 |
| 4,082,078 | A | * | 4/1978 | Thuleen et al. | 126/197 |
| 4,105,229 | A | | 8/1978 | Kaldenberg | |
| 4,179,821 | A | * | 12/1979 | Herbst et al. | 34/235 |
| 4,179,907 | A | * | 12/1979 | Schantz | 68/12 R |
| 4,186,287 | A | | 1/1980 | Scott | |
| 4,249,760 | A | * | 2/1981 | Conley | 292/197 |
| 4,502,715 | A | * | 3/1985 | Lundblade | 292/78 |
| 4,745,250 | A | * | 5/1988 | Mayo | 219/10.55 |
| 4,750,503 | A | * | 6/1988 | Noren | 134/57 DL |
| 4,764,648 | A | * | 8/1988 | Resh | 200/50 A |
| 4,776,620 | A | * | 10/1988 | Marks et al. | 292/228 |
| 4,917,414 | A | | 4/1990 | Boulanger | |
| 5,168,621 | A | | 12/1992 | Kruck et al. | |
| 5,174,618 | A | * | 12/1992 | Kropf | 292/254 |
| 5,342,103 | A | * | 8/1994 | Tame et al. | 292/341.17 |
| 5,374,118 | A | | 12/1994 | Kruck et al. | |
| 5,810,403 | A | | 9/1998 | Prada | |
| 6,036,241 | A | * | 3/2000 | Osdiek et al. | 292/229 |

* cited by examiner

*Primary Examiner*—Robert J. Sandy
*Assistant Examiner*—Carlos Lugo
(74) *Attorney, Agent, or Firm*—George L. Rideout, Jr. Esq.; Armstrong Teadsale LLP

(57) ABSTRACT

A latch assembly includes a handle, a handle retainer, and a keeper. The keeper includes a biasing mechanism and a head comprising a catch, a lock release projection, and a switch actuator. The keeper biasing member configured to facilitate engaging the catch with the door. The handle biasing member configured to facilitate maintaining the handle in a first position. The handle includes a contact surface slidingly coupled to the lock release projection to facilitate coupling the door to the tub assembly.

17 Claims, 3 Drawing Sheets

METHODS AND APPARATUS FOR SECURING A DISHWASHER DOOR

BACKGROUND OF INVENTION

This invention relates generally to door latches, and more particularly, to methods and apparatus for securing an appliance door in a closed position.

At least some known dishwashers include a hinged door and a latch assembly that prevents the dishwasher from operating unless the door is latched in a closed position. To facilitate dishwasher operation, the latch assembly performs several different functions, including, securing the door to the tub assembly in a closed position, interrupting dishwasher operations when the door is opened, and restoring dishwasher operations when the door is returned to a closed position.

To perform such functions, at least some known latch assemblies include a plurality of stationary and moving components which interact with each other. However, because of the number and complexity of components, assembly of such latch assemblies may be a costly and time consuming process.

SUMMARY OF INVENTION

In one aspect, a latch assembly includes a keeper which includes a biasing member and a head portion extending from the biasing member. The head portion includes a catch and a lock release projection. The biasing member is configured to bias the catch for engagement with the door. The handle includes a contact surface in slidable contact with the lock release projection. The handle is selectively operable to unsecure the door from the tub assembly. A handle retainer couples the handle to the door.

In another aspect, a method for assembling a door latch assembly for a dishwasher is provided. The latch assembly is configured to secure a dishwasher door to a dishwasher tub assembly. The method includes providing a handle, providing a handle retainer, connecting the handle to the handle retainer, and installing a keeper such that the keeper is slidably coupled to the handle.

In a further aspect, a dishwasher includes a tub assembly, a door hingedly coupled at a first edge to the dishwasher, and a latch assembly for securing the dishwasher door to the dishwasher tub assembly. The latch assembly includes a handle and a keeper slidably coupled with the handle. The handle is rotatable in a first direction, and the keeper is rotatable in a second direction opposite the first direction.

DETAILED DESCRIPTION

Figure 1:
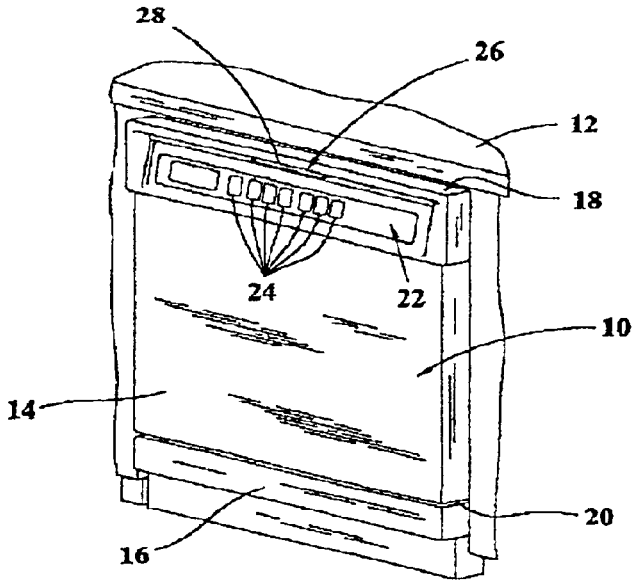
FIG. 1 is a perspective view of an under-the-counter type dishwasher with portions of the counter cut away.

FIG. 1 is a perspective view of an under-the-counter type dishwasher 10 installed beneath a counter 12. Dishwasher 10 includes a door 14 and a base 16. Door 14 includes an upper edge 18 and a lower edge 20 which is hingedly coupled to base 16. A control panel 22 including a plurality of controls 24 is secured to door 14. Dishwasher 10 also includes a latch assembly 26. In the exemplary embodiment, latch assembly 26 includes a handle 28.

In use, an operator depresses handle 28 to open door 14. If dishwasher 10 is in operation, operation is interrupted, or is prevented, until door 14 is returned to a closed position. Door 14 can then be freely opened for loading or unloading dishes. To enable operations, an operator simply closes door 14 to re-engage latch assembly 26 such that door 14 is secured in a closed position.

Figure 2:
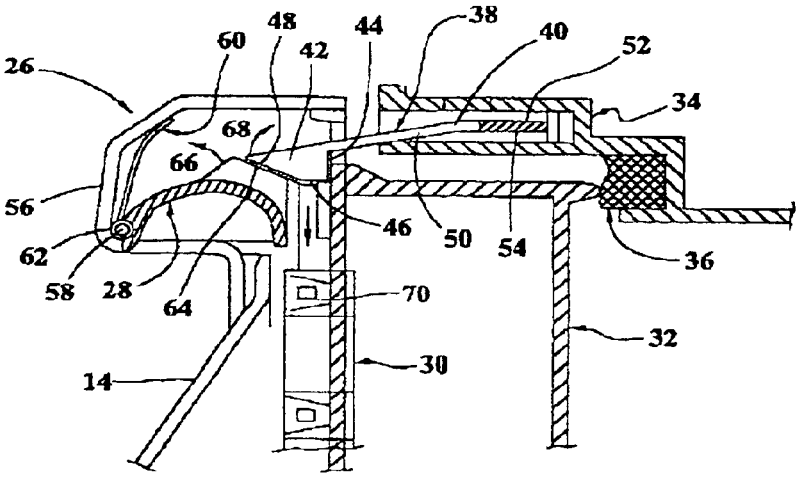
FIG. 2 is a partial cross-sectional view of the latch assembly shown in FIG. 1 in a closed position.

FIG. 2 is a partial cross-sectional view of latch assembly 26 (shown in FIG. 1) mounted to dishwasher door 14 (shown in FIG. 1). More specifically, FIG. 2 illustrates dishwasher door 14 and latch assembly 26 in a closed position. Dishwasher door 14 includes an outer wall 30 and an inner wall 32. Dishwasher 10 (shown in FIG. 1) also includes a tub assembly 34 that includes a gasket 36. Gasket 36 engages to inner wall 32 to form a seal between door 14 and tub assembly 34 when door 14 is secured in a closed position.

In an exemplary embodiment, latch assembly 26 includes a keeper 38 attached to tub assembly 34. In one embodiment, keeper 38 is formed integrally with tub assembly 34. Keeper 38 includes a biasing member 40 and a head 42. In one embodiment, biasing member 40 is formed unitarily with head 42. Alternatively, biasing member 40 and head 42 are separate components. In an exemplary embodiment, biasing member 40 and head 42 are formed integrally. Head 42 includes a catch 44, a switch actuator 46, and a lock release projection 48. In one embodiment, biasing member 40 and head 42 are formed from a metallic material. In another embodiment, biasing member 40 and head 42 are formed from a non-metallic material. Biasing member 40 has a thickness 50 that is measured between a top surface 52 and a bottom surface 54 of biasing member 40. Thickness 50 is variably selected such that keeper 38 has a pre-determined flexibility to facilitate opening and closing of the door 14.

In the exemplary embodiment, latch assembly 26 also includes handle 28, a handle retainer 56, and a hinge pin 58. In one embodiment, handle 28 includes a biasing member 60, at least one pivot arm 62, and a handle contact surface 64. Pivot arm 62 is substantially circular and includes at least one opening therein for mating with hinge pin 58. In one embodiment, handle retainer 56 is secured in a stationary position. In another embodiment, handle 28 is rotatably coupled to handle retainer 56 using hinge pin 58. In a further embodiment, handle 28 is frictionally attached to handle retainer 56 without using hinge pin 58. Handle 28 and hinge pin 58 are rotatably coupled such that handle 28 rotates in a first direction 66. In one embodiment, handle 28 is formed unitarily with biasing member 60, and biasing member 60 is slidably coupled with handle retainer 56. Alternatively, handle 28 and biasing member 60 are separate components. In a further embodiment, handle 28, handle retainer 56, hinge pin 58, biasing member 60, pivot arm 62, and contact surface 64 are fabricated from a plastic material. Alternatively, at least one of handle 28, handle retainer 56, hinge pin 58, biasing member 60, pivot arm 62, and contact surface 64 is fabricated from a non-plastic material.

In use, handle 28 and keeper 38, are in a first position such that a switch 70 is in a closed state, keeper 38 is securing door 14 to tub assembly 34, and dishwasher operations are enabled. When handle 28 rotates in first direction 66, contact surface 64 makes sliding contact with lock release projection 48. Such contact causes keeper 38 to rotate in a second direction 68 that is opposite from first direction 66, and dishwasher operations are interrupted.

Figure 3:
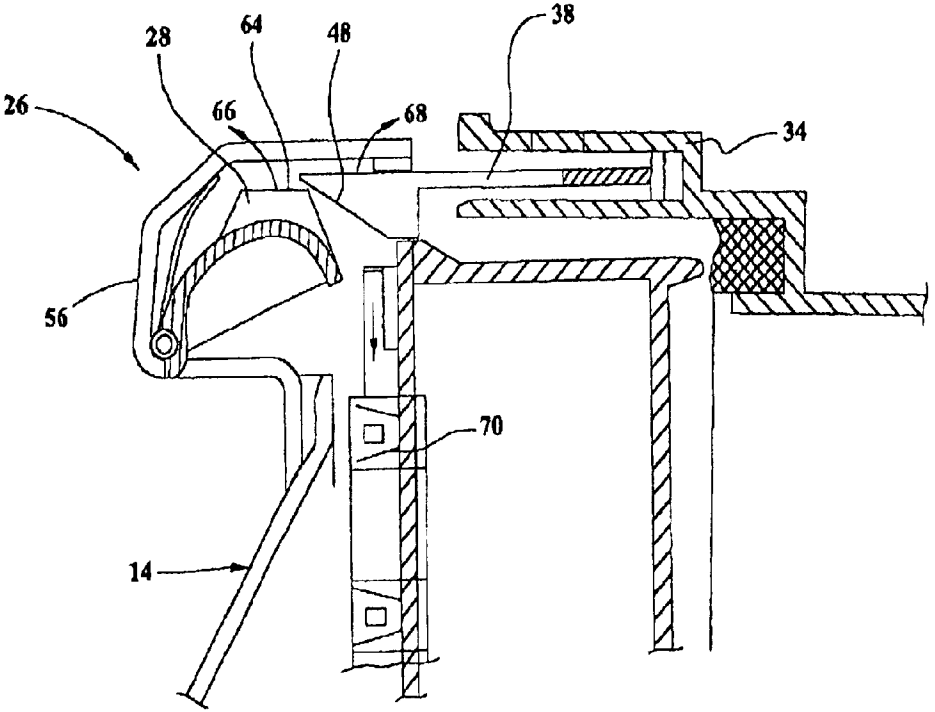
FIG. 3 is a partial cross-sectional view of the latch assembly shown in FIG. 1 in an open position.

FIG. 3 is a partial cross-sectional view, of latch assembly 26 (shown in FIG. 1) mounted to dishwasher door 14 (shown in FIG. 1). More specifically, FIG. 3 illustrates door 14 and latch assembly 26 in an open position.

In use, handle 28 and keeper 38, are in a first position such that switch 70 is in a closed state, keeper 38 is securing door 14 to tub assembly 34, and dishwasher operations are enabled. When handle 28 rotates in first direction 66, contact surface 64 makes slidable contact with lock release projection 48. Such slidable contact causes keeper 38 to rotate in a second direction 68 that is opposite from first direction 66. Keeper 38 then unsecures door 14 from tub assembly 34, switch 70 transitions from a closed state to an open state, and dishwasher operations are interrupted.

During assembly, latch assembly 26 is attached to dishwasher 10 and secures dishwasher door 14 to dishwasher tub assembly 34. Handle retainer 56 includes at least one substantially circular projection that frictionally connects handle 28 to handle retainer 56. Keeper 38 is attached to dishwasher tub assembly 34 such that keeper 38 is slidably coupled to handle 28.

Figure 4:
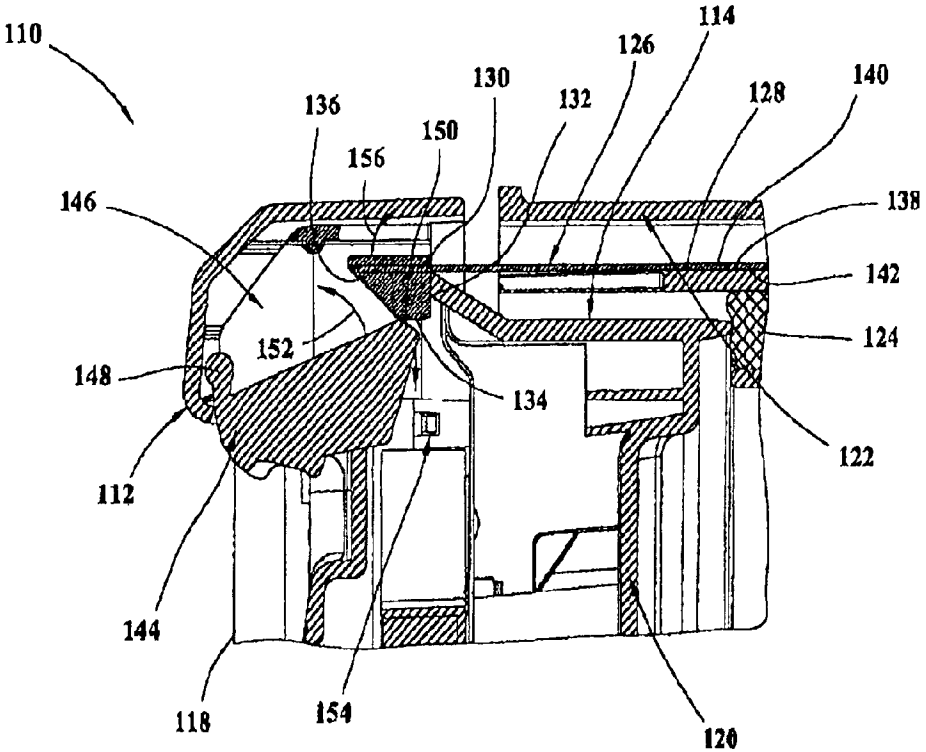
FIG. 4 is a partial cross-sectional view, of an alternative embodiment, of a latch assembly that may be used with the dishwasher shown in FIG. 1.

FIG. 4 is a partial cross-sectional view of an alternative embodiment of a latch assembly 110 that may be used with a dishwasher (not shown) such as dishwasher 10 shown in FIG. 1. Door 112 includes an upper edge 114 and a lower edge (not shown) which is hingedly coupled to a base (not shown). Dishwasher door 112 also includes an outer wall 118 and an inner wall 120. The dishwasher includes a tub assembly 122 including a gasket 124. Gasket 124 engages inner wall 120 to form a seal between door 12 and tub assembly 122 when door 112 is secured in a closed position.

In an exemplary embodiment, latch assembly 110 includes a keeper 126 attached to tub assembly 122. In one embodiment, keeper 126 is formed integrally with tub assembly 122. Keeper 126 includes a biasing member 128 and a head 130. In one embodiment, biasing member 128 is formed unitarily with head 130. In an exemplary embodiment, biasing member 128 is formed integrally with head 130. Alternatively, biasing member 128 and head 130 are separate components. Head 130 includes a catch 132, a switch actuator 134, and a lock release projection 136. In one embodiment, biasing member 128 and head 130 are formed from a metallic material. In another embodiment, biasing member 128 and head 130 are formed from a non-metallic material. Biasing member 128 also has a thickness 138 measured between a top surface 140 and a bottom surface 142 of biasing member 128. Thickness 138 is variably selected such that keeper 126 has a pre-determined flexibility to facilitate opening and closing door 112.

In the exemplary embodiment, latch assembly 110 also includes a handle 144, and a handle retainer 146. In one embodiment, handle 144 includes at least one pivot arm 148, and a contact surface 150. Pivot arm 148 is substantially circular and includes at least one opening therein for mating with handle retainer 146. In one embodiment, handle retainer 146 frictionally retains handle 144. In an alternative embodiment, handle 144 is pivotally attached to handle retainer 146 with a hinge pin (not shown). Handle retainer 146 and handle 144 are rotatably coupled such that handle 144 rotates in a first direction 152. In one embodiment, contact surface 150 includes a substantially planar surface and lock release projection 136 includes a substantially planar surface, such that contact surface 150 planar surface and lock release projection 136 planar surface are in slidable contact. In one embodiment, handle 144, handle retainer 146, pivot arm 148, and contact surface 150 are formed from a plastic material. In an alternative embodiment, at least one of handle 144, handle retainer 146, pivot arm 148, and contact surface 150 is formed from a non-plastic material.

In use, handle 144 and keeper 126, are in a first position such that a switch 154 is in a closed state, keeper 126 is securing door 112 to tub assembly 122, and dishwasher operations are enabled. When handle 144 rotates in first direction 152, contact surface 150 makes sliding contact with lock release projection 136. Such contact causes keeper 126 to rotate in a second direction 156 that is opposite from first direction 152. Keeper 126 unsecures door 112 from tub assembly 122, switch 154 transitions from a closed state to an open state, and dishwasher operations are interrupted.

The above described latch assembly includes a keeper, a handle retainer, and a handle attached to the handle retainer such that the handle slidably couples with the keeper to open or close the door. The latch assembly uses fewer components than other known latch assemblies, and is thus less complex than other known latch assemblies. As a result, assembly of the latch assembly is facilitated to be more cost effective and less time consuming.

While the invention has been described in terms of various specific embodiments, those skilled in the art will recognize that the invention can be practiced with modification within the spirit and scope of the claims.

What is claimed is:

1. A latch assembly for coupling a door to an apparatus, said latch assembly comprising:

a keeper comprising a biasing member and a head portion extending from said biasing member, said head portion comprising a catch and a lack release projection, said biasing member configured to bias said catch for engagement with the door;

a handle comprising a contact surface in slidable contact with said lock release projection, said handle selectively operable to uncouple the door from the apparatus; and a handle retainer coupling said handle to the door; and a handle hinge pin, said handle hinge pin coupling said handle to said handle retainer.

2. A latch assembly in accordance with claim 1 further comprising a handle biasing member biasing said handle in a first position.

3. A latch assembly in accordance with claim 2 wherein said handle biasing member in slidable contact with said handle retainer.

4. A latch assembly in accordance with claim 1 wherein said keeper head portion is formed integrally with said keeper biasing member.

5. A latch assembly in accordance with claim 1 wherein said handle retainer is fixedly attached to the door.

6. A latch assembly in accordance with claim 1 wherein said handle is rotatably coupled to the door with said hinge pin.

7. A latch assembly in accordance with claim 1 wherein said handle further comprises at least one pivot arm comprising at least one opening therein sized to receive said handle hinge pin.

8. A dishwasher comprising:

a rub assembly;

a door hingedly coupled at first edge to said tub assembly; and a latch assembly configured to secure said door to said tub assembly, said latch assembly comprising:

a handle; and a keeper is slidably coupled with said handle, said handle rotatable in a first direction, said keeper rotatable in a second direction opposite said first direction, said keeper including a biasing member and a head portion extending from said biasing member, said head portion including a catch and a lock release projection, said biasing member configured to bias said catch for engagement with said door.

9. A latch assembly in accordance with claim 8 wherein said handle comprises a substantially planar surface, said keeper comprises a substantialily planar surface in slidable contact with said handle planar surface.

10. A latch assembly in accordance with claim 8 wherein said handle further comprises a contact surface in slidable contact with said release projection, said handle selectively operable to unsecure said door from said tub assembly.

11. A latch assembly for coupling a door to an apparatus, said latch assembly comprising:

a keeper comprising a biasing member and a head portion extending from said biasing member, said head portion comprising a catch and a lock release projection, said biasing member configured to bias said catch for engagement with the door, said keeper head portion further comprising a switch actuator;

a handle comprising a contact surface in slidable contact with said lock release projection, said handle selectively operable to uncouple the door from the tub assembly; and a handle retainer coupling said handle to the door.

12. A latch assembly in accordance with claim 11 wherein said switch actuator is configured to actuate a switch from an open state to a closed state.

13. A method for assembling a door latch assembly for a dishwasher, the latch assembly for securing a dishwasher door to a dishwasher tub assembly, said method comprising:

providing a handle;

providing a handle retainer;

providing a keeper, mounting the keeper to the dishwasher tub;

mounting the handle retainer to the dishwasher door;

connecting the handle to the handle retainer; and slidably coupling the keeper to the handle such that the handle is rotatable in a first direction and the keeper is rotatable in a second direction that is opposite the first direction.

14. A method in accordance with claim 13 wherein providing a handle further comprises providing a handle including at least one substantially circular projection that is configured to frictionally attach the handle to the handle retainer.

15. A method in accordance with claim 13 wherein mounting a keeper further comprises mounting a keeper for engagement with a switch that enables operation of the dishwasher when the dishwasher door is closed.

16. A method in accordance with claim 13 wherein providing a handle retainer further comprises providing a handle retainer including at least one substantially circular projection that is configured to frictionally retain a hinge pin.

17. A latch assembly for coupling a door to an apparatus, said latch assembly comprising:

a keeper comprising a biasing member and a head portion extending from said biasing member, said head portion comprising a catch and a lock release projection, said biasing member configured to bias said catch for engagement with the door, a rotatably mounted handle comprising a contact surface in slidable contact with said lock release projection, said handle selectively rotatable to uncouple the door from the apparatus; and a handle retainer coupling said handle to the door.

* * * * *

UNITED STATES PATENT AND TRADEMARK OFFICE

CERTIFICATE OF CORRECTION

PATENT NO. : 6,761,381 B2
DATED : July 13, 2004
INVENTOR(S) : Prada et al.

It is certified that error appears in the above-identified patent and that said Letters Patent is hereby corrected as shown below:

Column 4,
Line 33, delete "lack" and insert therefor -- lock --.

Signed and Sealed this

Sixth Day of December, 2005

JON W. DUDAS
*Director of the United States Patent and Trademark Office*